United States Patent [19]

Rubio

[11] 4,329,168

[45] May 11, 1982

[54] AMINE TREATMENT FOR PASSIVATING SPONGE IRON

[76] Inventor: Charles A. Rubio, 2600 S. Gessner, Houston, Tex. 77063

[21] Appl. No.: 165,199

[22] Filed: Jul. 1, 1980

[51] Int. Cl.[3] ..... C23F 11/02

[52] U.S. Cl. ..... 75/0.5 BA; 75/34

[58] Field of Search ..... 148/16.6, 6.35; 75/26, 75/0.5 BA, 33, 34, 35; 427/216

[56] References Cited

U.S. PATENT DOCUMENTS

| | | | |
|---|---|---|---|
| 2,862,808 | 12/1958 | De Jahn | 75/34 |
| 3,346,366 | 10/1967 | Mayer et al. | 75/26 |
| 4,169,533 | 10/1979 | Rubio | 75/34 |

FOREIGN PATENT DOCUMENTS

| | | | |
|---|---|---|---|
| 2105549 | 8/1972 | Fed. Rep. of Germany | 148/16.6 |

*Primary Examiner*—M. J. Andrews

*Attorney, Agent, or Firm*—Pravel, Gambrell, Hewitt, Kirk, Kimball & Dodge

[57] ABSTRACT

Sponge iron may be passivated against reoxidation by air and water vapor by contacting it with an amine containing from about one to about twelve carbon atoms. The amine contact may be accomplished in the vapor phase by adding the amine to a cooling gas which is employed to cool freshly reduced sponge iron to a safe temperature. Alternatively, the cooled sponge iron may be immersed in an aqueous amine solution to inhibit it against reoxidation.

15 Claims, 4 Drawing Figures

AMINE TREATMENT FOR PASSIVATING SPONGE IRON

BACKGROUND OF THE INVENTION

This invention relates to the treatment of pyrophoric materials such as sponge iron.

Sponge iron is utilized in the steel making industry as a basic raw material source for the production of steel. Generally speaking, sponge iron is produced by exposing hematite ($Fe_2O_3$) iron ore in comminuted form to a reducing gas environment at temperatures somewhat below blast furnace temperatures. The production of sponge iron is the subject of a large number of patents, including the following U.S. Pat. Nos.: 2,243,110; 2,793,946; 2,807,535; 2,900,247; 2,915,379; 3,128,174; 3,136,623; 3,136,624; 3,135,625; 3,375,098; 3,423,201; 3,684,386; 3,765,872; 3,770,421; 3,779,741; 3,816,102; 3,827,879; 3,890,142; and, 3,904,397. The final sponge iron product of practically all of the processes disclosed in these patents is in a particulate or pellet form.

Typically, the components of sponge iron are metallic iron, iron oxide, gangue and possibly carbon. Metallic iron is iron which has been totally reduced by the reducing gas environment. Gangue is the term used in the industry to refer to all non-ferrous material, except carbon contained in the ore. Gangue may include silica, alumnia, lime, magnesia, phosphorus, sulfur and possibly other materials. A deposit of carbon on the outside surface of the sponge iron particulate will be described in greater detail hereinafter. In all of the iron ore reduction processes just referred to, freshly produced sponge iron as found in the final step of the process may be at a temperature of 300° F. or, in some cases, significantly higher. The freshly produced sponge iron must be moved from the reactor to some type of storage location or be immediately utilized in a steel producing process. In the past, it was more typical that the freshly produced sponge iron be used rather quickly in the production of steel. However, in the last few years, this situation has changed. There are more and more iron ore reducing plants being built in various parts of the world entirely removed from steel producing facilities. Therefore, it has become necessary that sponge iron be stored and even shipped long distances.

Freshly produced sponge iron is not a stable material. In fact, such sponge iron is pyrophoric and subject to degradation through oxidation by exposure to air or water.

There are two mechanisms by which sponge iron is believed to reoxidize. In the first mechanism sponge iron will react with dry air—i.e. oxygen—to form a magnetite by the following reaction:

$$3Fe+2O_2 \rightarrow Fe_3O_4 \quad (1)$$

This reaction is very exothermic and can generate enough heat to spontaneously ignite adjacent sponge iron particles. Reoxidization presents a particularily aggravated problem when the sponge iron is already at high temperatures such as when it is removed from the reduction furnace.

The problem of pacifying freshly produced sponge iron against reoxidation conventionally involves cooling it to a safe temperature.

Attempts to at least partially cool the sponge iron to a safe temperature are found in the prior art. It is known that freshly reduced sponge iron must be cooled down significantly. Some cooling has been incorporated into the reduction process. Generally, this initial cooling occurs while the sponge iron is still in the reduction reactor. U.S. Pat. No. 3,904,397 of Celada and others discloses the utilization of cooled, spent reducing gas in such a cooling reactor. Other U.S. patents which refer generally to the utilization of a cooling step immediately after reduction include U.S. Pat. Nos. 3,765,872; 3,684,486; 3,136,625; 3,136,624; and, 3,136,623. Recently, I have discovered and disclosed a separation and cooling process by which sponge iron may be better pacified against reoxidation. A description of this new process is found in my U.S. Pat. No. 4,169,533.

A second mechanism by which sponge iron is believed to reoxidize involves its reaction with water vapor and air. This process is referred to as "rusting" and proceeds by a two stage reaction as follows:

$$2Fe+2H_2O+O_2 \rightarrow 2Fe(OH)_2 \quad (2)$$

$$2Fe(OH)_2+H_2O+\tfrac{1}{2}O_2 \rightarrow Fe_2O_3+3H_2O \quad (3)$$

The hydrated ferric oxide formed by reaction (3) may undergo yet another reaction:

$$3Fe(OH)_2 \rightarrow Fe_3O_4+H_2 \quad (3)$$

to liberate water and hydrogen.

The "rusting" process not only results in the loss of pure iron which presents a serious economic loss over long periods of storage—estimated loss to rust may be as high as 1.5% by weight per month—it also presents a dangerous shipping problem since hydrogen is generated as a by-product of the rusting reactions.

Since in many cases sponge iron facilities are located at great distances from steel mills, and often must be transported to such distant mills by sea transport, some method must be found by which its tendency to rapidly reoxidize upon contact with moisture in the air, with the consequential liberation of heat and hydrogen, can be eliminated or significantly reduced.

Although sponge iron treated in accordance with the process disclosed in my U.S. Pat. No. 4,169,533 has greatly reduced reoxidation tendencies—whether contacted by air alone or the combination of air and water vapor—the tendency to reoxidize upon contact with moisture may still persist to an undesirable degree.

Ideally, the reoxidation problem could be overcome if the sponge iron could be contacted with a substance which would coat and shield its active metal surfaces from contact with air or moisture or otherwise inhibit the occurence of the oxidation reactions at such surfaces.

Several coating methods have been disclosed in the prior art. U.S. Pat. Nos. 3,816,102 of Celada et al. and 3,136,624 of Mader et al. disclose a process for coating or depositing a layer of carbon onto the hot sponge iron during the initial cooling of the just-reduced sponge iron. Carbon is deposited for the next step in the process, i.e. an electric furnace, which converts the iron to steel, and also the carbon present reacts with the remaining iron oxide to finish the reduction ($FeO+C \rightarrow CO+Fe$). One of the results of the deposition of the carbon layer on the sponge iron is the formation of a protective exterior shell against reoxidation of the hot sponge iron because iron combined with carbon, such as $Fe_3C$, is supposedly less sensitive to oxygenation than the reduced metallic sponge iron. "Storage and Transportation of HYL DRI Pellets" presented by Ing. Raul G. Quintero, Hylsa, S.A. and Mr. G. E. McCombs, Pullman Swindell, Third Direct Reduction Congress, Instituto Latinoamericano del Fierro y el Acero, Caracas, Venezuela, July, 1977. U.S. Pat. No. 3,423,201 of Celada et al. discloses a method for cooling sponge iron having such a carbon layer deposited thereon. In Celada U.S. Pat. No. 3,423,201, a second cooling step is initiated when the temperature of the reduced ferrous material in the cooling reactor has dropped below the value at which cracking of reducing gas (and thus depositing of carbon on the sponge iron particulate) occurs. The Celada U.S. Pat. No. 3,423,201 states that the sponge iron is cooled to a temperature "near room temperature".

Another recent coating process for rust prevention was disclosed by U.S. Pat. No. 4,069,015, wherein sponge iron is immersed in an aqueous solution of a water soluble alkali metal silicate. As discussed therein many other coating materials have been suggested in the prior art, such as asphalt, plastics, and waxes.

Another proposed solution to this problem has been suggested by the Midrex Corporation. Midrex Corporation has made public a chemical treating process sold under the trademark CHEMAIRE. The CHEMAIRE process is a combination of chemical treatment and air passivation to inhibit rusting and reoxidation. "Direct From Midrex", Vol. 3, No. 2 brochure. Disadvantages of this type of system are several. First of all, the complete distribution of the chemical upon the particulte sponge iron is very unlikely. Secondly, the addition of the chemicals may or may not have any effect upon subsequent use of the sponge iron in the production of steel.

Although many types of protective coatings have been suggested none have proved very satisfactory when applied to sponge iron. In part this has been due to their expense, the difficulty in applying them to the sponge iron and their subsequent contaminating effect upon any steel which may be produced from a coated sponge iron.

Additionally, since sponge iron is a very porous material and thus has active or oxidation prone surfaces on both the exterior and the interior of the pellets any coating to be fully effective must be applied to all such surfaces. Coating suggested in the prior art for the most part lack the fluidity necessary to penetrate through the complex of minute pores of the sponge iron pellet and thus provide no protective coating on its interior active metal surfaces. Since prior art coating exist only on the pellets' exterior surface it may easily be damaged during storage or loading processes thus removing it in those areas wherein the pellets are contacted by other pellets or objects. Once the coating is removed the uncoated interior active metal surfaces are fully exposed to air and moisture and hence are susceptible to reoxidation.

For any sponge iron coating or inhibiting process to be a viable solution to the reoxidation problem the substance which is applied to coat or inhibit the sponge iron, it must be inexpensive, easy to apply, be a non-contaminate to the steel making process and be capable of application to both the exterior and interior active metal surface of the sponge iron. Desirably, any such coating or inhibiting material should be capable of application to the sponge iron by adding it to a cooling gas which is used to reduce the temperature of such sponge iron to a safe level.

As yet, no completely satisfactory coating or inhibiting material has been suggested or disclosed in the prior art. Additionally, no gas cooling process extant prior to that disclosed in my U.S. Pat. No. 4,169,533 has been suggested or disclosed which would insure that a suitable coating or inhibiting material, once found, could be thoroughly and completely contacted with a bulk mass of sponge iron so as to insure that substantially all pellets thereof are equally treated with such material.

Basically, all of the prior sponge iron cooling processes disclose the cooling of the sponge iron while still in a reactor. In order to cool the sponge iron in a reactor, it is necessary for the cooling gas to flow through a bulk mass, or pile of sponge iron. Typically, the cooling gas takes the paths of least resistance and therefore is not equally distributed among all the sponge iron particulate. Further, the cooling gas serves to deposit fines in particular locations out of the flow paths of direct cooling gas flow so that hot spots of fines are formed. Such fines may also obstruct flow paths through the particulate and thus prevent cooling. Hence any protective coating or inhibiting material which is added to the cooling gas would not equally contact all pellets of the sponge iron mass.

In summary, no completely suitable coating or inhibiting material has been disclosed which is satisfactory from the standpoint of cost, ease of application, interior-exterior coating properties and which is non-contaminating to subsequent steel manufacturing. Also, no conventional cooling process has been disclosed by which a suitable coating or inhibiting material may be completely and thoroughly contacted with a bulk mass of sponge iron pellets whereby substantially total coating or inhibiting of all of the bulk mass may be achieved simultaneously with cooling of the sponge iron.

SUMMARY OF THE INVENTION

I have now discovered that amines having from about two to about twelve carbon atoms, when contacted with a sponge iron mass at a temperature of from about 125° F. to about 250° F. will interact with the active surfaces thereof—interior and exterior—to provide a protective "coating" thereon or otherwise inhibit the sponge iron so as to substantially reduce or eliminate its tendency to reoxide. The amine may be contacted with the sponge iron in the gas phase by adding it to a cooling gas employed to cool hot sponge iron from the direct reduction furnace. When added to a cooling gas and applied to the bulk mass of sponge iron by the process disclosed in my U.S. Pat. No. 4,169,533 a complete and thorough contact may be achieved.

Alternatively, cooled sponge iron may be immersed in an aqueous solution containing an amine, and subsequently dried, to protect it against reoxidation.

DESCRIPTION OF THE PREFERRED EMBODIMENT

Figure 2:
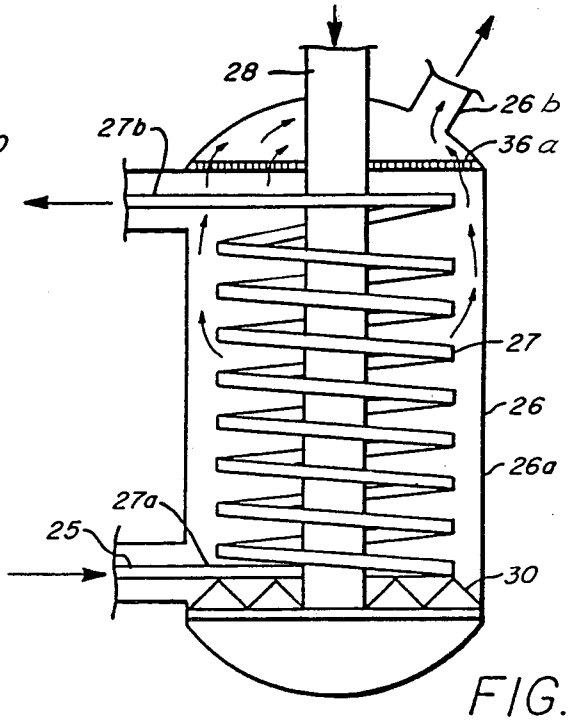
FIG. 2 is a side, schematic view of the vessel containing the apparatus for simultaneously conveying and cooling certain sponge iron particulate.

Generally, amines found to be useful in protecting sponge iron against reoxidization are those aliphatic amines which range from about one to about twelve in their number of carbon atoms. Ammonia may also be used. This would include amines such as: methyl amine, dimethyl amine, trimethyl amine, ethyl amine, diethyl amine, n-propyl amine, di-n-propyl amine, isopropyl amine, n-butyl amine, isobutyl amine, sec-butyl amine, tert-butyl amine, ethylene diamine, tetramethylene diamine and the like. Such amines may be saturated or contain elements of unsaturation.

The above is not an exhaustive list of all the various amines which may be used to treat sponge iron to prevent is reoxidation. Generally, any aliphatic amine which has a boiling point of about 250° F. (121° C.) or less may be used. Diamines and triamines are preferred since they possess a higher degree of functionality per molecule than mono amines and hence should more readily adhere (by absorption, reaction or condensation) to the active metal surfaces of the sponge iron.

Although it may be possible to employ aromatic amines, such as benzyl amine, phenylethyl amines and the like, they generally have boiling points in excess of the temperatures at which the sponge iron will be treated and are more expensive than aliphatic amines, hence are not preferred.

The sponge iron may be contacted with the amine by several methods. The amine in a vapor phase may be contacted with partially cooled sponge iron from the direct reduction furnace which at the time of contact is between about 125° F. to about 250° F. in temperature. Or the sponge iron may be cooled to about 70° F. or less and then contacted with an aqueous amine solution. A third mode of treatment may be employed wherein the cooling process described in my U.S. Pat. No. 4,169,533 is used. This third method would comprise a combination of gas phase treatment with a vaporized amine simultaneous with contacting the sponge iron with a spray of an aqueous amine solution. The procedure by which the latter method may be accomplished will become apparent when the method of the cooling process of U.S. Pat. No. 4,169,533 is discussed subsequently.

Contacting an amine with freshly produced and partially cooled (125°–250° F.) sponge iron acts to passivate or inhibit the quick reoxidation of the active metal surfaces thereof upon its exposure to air and water vapor.

Additionally, it should be realized that sponge iron is a porous substance and that it contains active iron surfaces on both the interior and exterior of the pellets. To the extent that the amine molecule employed in the sponge iron treatment has a smaller cross-sectional size than that of the pores of the sponge iron, and thus can enter the pore, it will contact the interior active iron surfaces of the pellets and inhibit reoxidation thereof. To the extent that the pellet contains pores of smaller cross-sectional size than that of the amine used the amine will only interact with the iron surface at the opening of the pore—yet such interaction will tend to obstruct the openings of such pores to access by oxygen or water vapor.

Thus, it may be seen that linear amines are preferred from the standpoint that they represent a smaller average cross section size than branched amines and thus are more likely to permeate through the pores to inhibit the active surfaces interior to the pellets. Branched amines on the other hand, are less likely to enter into the smaller pores of the sponge iron pellets but are more likely to react at their opening and thus obstruct them to access by oxygen and moisture.

The sponge iron to be treated may be contacted with an amine in a number of ways. All freshly reduced sponge iron must be cooled to a safe temperature to prevent its pyroforic reoxidation with oxygen in the atmosphere. Cooling is generally accomplished by circulating a cooling gas through the sponge iron mass. When such a gas is used, the most convenient method of contacting the amine with the sponge iron is to add the amine to the cooling gas.

In most direct reduction processes the freshly produced sponge iron is initially cooled while still contained in the direct reduction reactor to a temperature of from about 125° F. to about 250° F. Thereafter it is passed out of the reactor to an intermediate cooling stage wherein it is further cooled with inert gases, such as $N_2$, to a temperature below about 120° F.

The amine treatment may most easily be accomplished during the intermediate cooling process by adding it to the cooling gas employed therein. The amine may be first vaporized by heating and added to the cooling gas immediately ahead of the intermediate cooling step or may be sprayed into the cooling gas to form an aerosol. If added to the cooling gas as an aerosol the amine will readily vaporize upon contact with the hot sponge iron.

The amount of the amine added to the cooling gas should comprise from about 500 to about 20,000 ppm by volumn. Excess amine may be employed since the excess will be recovered with the cooling gas and will be recycled therewith. Generally, it is preferred to add the amine in an amount sufficient to provide a concentration of between about 2,000 to about 5,000 ppm.

To insure thorough permeation of the sponge iron pellets by the amine contained in the cooling gas, the cooling gas pressure level may be cycled through a pressure range of from about 25 to about 100 inches of $H_2O$ gauge. Preferably, pressure cycling of the amine containing cooling gas would be between 25 and 75 inches of $H_2O$ gauge, and the number of pressure cycles per minutes would be from about one to about thirty. Cycling the pressure in such fashion helps to drive the amine containing gas though the pellets and increases the probability of amine contact with all interior surface areas of the pellet subject to reoxidation.

Sponge iron pellet residence time in the cooling reactor where pressure cycling would be conducted runs from about 10 to about 20 minutes, and averages 15 minutes. Thus, at a pressure cycle rate of one per minute the pellets moving through the cooling reactor would be subject to from 10 to 20 pressure cycles and would average 15 pressure cycles. At a pressure cycle rate of 30 cycles per minute the pellets would be subject to from about 300 to about 600 pressure cycles, and would average 450.

Although the gas phase amine treating process described may be practiced in the cooling step of conventional direct reduction plants, it is most suitably employed in conjuncture with my recently disclosed cooling-separating process of U.S. Pat. No. 4,169,533.

Figure 3:
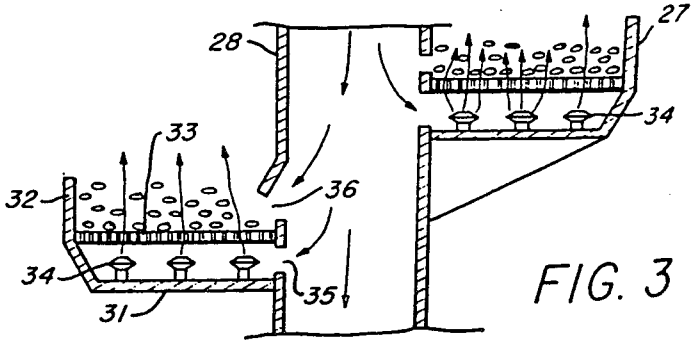
FIG. 3 is a schematic, sectional view of a portion of the apparatus of FIG. 2.
Figure 1:
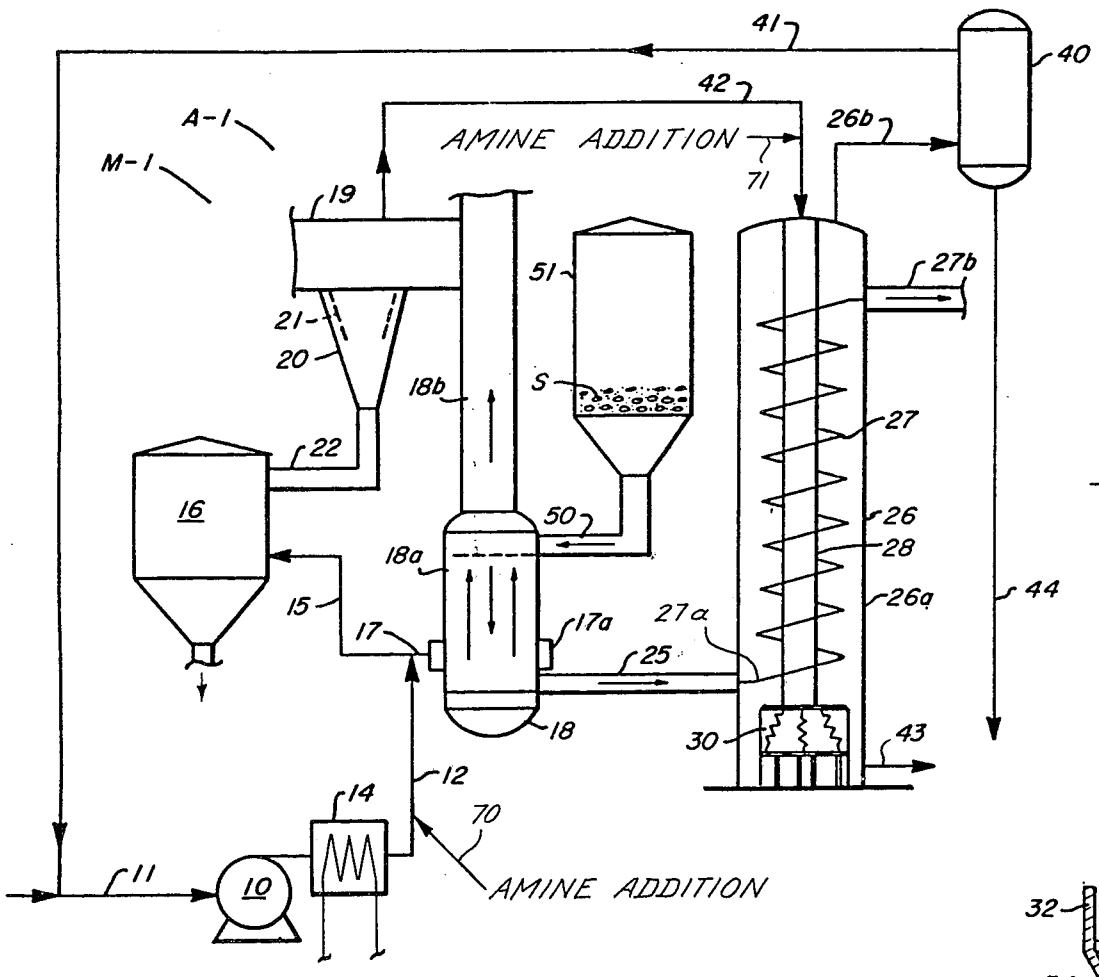
FIG. 1 is a schematic flow chart of a method for reducing the temperature of freshly reduced sponge iron to a safe level and various points at which an amine may be added to the cooling gas are illustrated.
Figure 4:
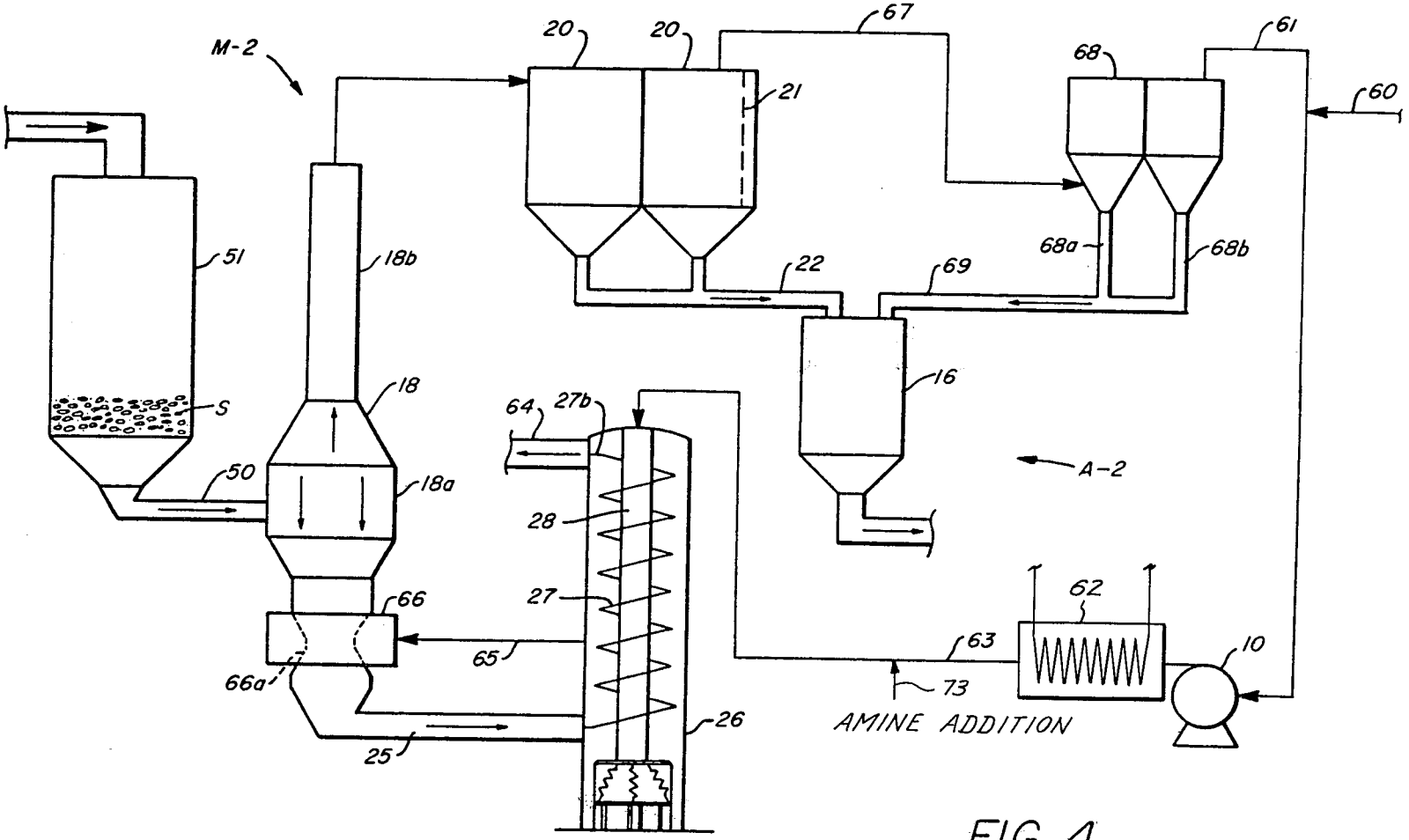
FIG. 4 is a schematic flow chart view of another embodiment of the method for reducing the temperature of recently-produced sponge iron to a safe level.

Referring to the drawings, FIGS. 1–3 illustrate a method generally designated as M-1 for reducing the temperature of freshly-reduced sponge iron to a safe level for storage and shipment. A second, equally important method M-2 for reducing the temperature of recently-produced sponge iron is illustrated in FIG. 4.

The method M-1 is carried out by the apparatus generally designated by the number A-1 in FIG. 1. The apparatus A-1 includes compressor 10 which is connected to inlet gas feed line 11 at its inlet and to outlet, compressed gas line 12 at its outlet. A cooling coil 14 is mounted in the compressed gas outlet line 12 for cooling the compressed gas prior to introduction through connecting line 15 to fines bin 16. Cooling coil M may be placed in gas feed line 11, prior to compressor 10, wherein it receives the warned cooling gas discharged from cooling reactor 26 by circulation through conduit 26*b*, scrubber 40, and conduit 41 and cools the recirculated gas to suitable cooling temperatures. However, cooling coil 14 is preferrably mounted after compressor 10, in order to also bring down the temperature rise which occurs in the cooling gas as it undergoes compression in compressor 10. The compressed gas line 12 is also connected by line 17 to a separator vessel or reactor 18.

The separator reactor 18 includes a main vessel housing 18*a* having a cylindrical riser 18*b* extending upwardly therefrom. The riser 18*b* is connected to conduit 19 which empties into a cyclone separator 20.

The cyclone separator 20 can be one of a number of commercially manufactured units, followed by a secondary dust removal system such as a bag house, electrostatic precipitator, or other commercially available equipment. The gas and fines in the cyclone separator are cooled by any type of surrounding water jacket structure such as shown schematically at 21. The filtering apparatus 20 is connected by collection conduit 22 to the fines bin 16.

A conveyor apparatus 25 is mounted in the bottom of the reactor vessel housing 18*a* for conveying sponge iron particulate from the vessel housing 18*a* to cooling reactor 26.

The cooling reactor 26 is shown schematically in FIG. 1 and in somewhat more detail, but also schematically, in FIGS. 2 and 3. A generally cylindrical vessel 26*a* mounts a vibratory spiralling conveyor platform 27 having a central support tube 28. The entire spiralling conveyor is permanently attached to the central support tube 28 and terminates in a horizontal entry conveyor portion 27*a* at the bottom thereof and in a horizontal exit conveyor portion 27*b* at the top thereof. The spiralling conveyor 27 and support tube 28 are both mounted for vibratory motion by a vibration imparting mechanism illustrated schematically and designated as 30. One such vibratory conveyor 27 having a central support tube 28 in vibratory mechanism 30 is available from Carrier Corporation.

Referring to FIG. 3, the spiralling conveyor 27 is formed by a spiralling platform 31 which is welded or otherwise connected to the central support tube or shaft 28. A side member or edge 32 is attached to the spiralling platform 31 and a second, perforated spiralling plate or deck 33 is attached to the side member 32 and extends parallel to the platform 31 for vibration therewith. The spiralling platform or deck 33 is also attached by suitable braces (not shown) to the central support tube 28. A plurality of nozzles 34 are mounted on the spiralling support platform 31 and are directed upwardly to spray fluid, liquid or gas upwardly through the perforated deck 33 into the sponge iron mass S supported on the plate 33. Openings 35 and 36 are positioned in the central support tube 28 above and below the perforated supporting deck 33 for passing a cooling gas both above and below the deck 33. The cooling gas is then circulated outwardly of the spiralling conveyor 27 and upwardly through the vessel top perforated support barrier 36*a* to reactor outlet 26*b*.

The gas outlet conduit 26*b* for cooling reactor vessel 26 is attached to a wet scrubber 40. The wet scrubber 40 is connected to conduit 41 which extends back into connection with inlet line 11.

The central support tube 28 of the cooling reactor 26 is connected to conduit 42 which provides for the transfer of cooling gas from separator 20 into the central support tube 28 for flow through the vibrating, spiralling deck 33 and the sponge iron positioned thereon.

A solids collection conduit 43 is attached to the bottom of the cooling reactor 26 and a slurry collection conduit 44 is attached to the bottom of the wet scrubber 40. The conduit 43 extends to the fines bin 16. Conduit 44 is connected to a separate system for cleaning and/or disposing of the slurry.

The amine to be added to the cooling gas, which is preferably $N_2$, may be added at amine addition points 70 or 71. If added at addition point 70 then it will contact the sponge iron in the fines separator reactor 18 and cyclone separator 20 as well as the sponge iron conveyed to the cooling reactor 26.

In practicing the method M-1 of this invention, recently-reduced sponge iron S is delivered into separator vessel housing 18*a* through horizontal conveyor 50 from reactor vessel 51, which is actually part of a sponge iron reducing system.

As the sponge iron enters the vessel housing 18*a* from conveyor 50, it tends to fall downwardly due to gravity. Preferably the amine is added at addition point 70 in the form of a vapor. The cooling gas at this point is generally about 70° F., therefore pre-vaporization of the amine would not be required if its boiling point is lower than 70° F. since it will naturally vaporize upon addition to the cooling gas. Otherwise, it is preferred to preheat the amine to its vapor state prior to addition to the cooling gas. Cooling gas and the added amine entering through line 17 and gas plenum 17*a* mounted about separator vessel housing 18*a* flows upwardly to fluidize the falling sponge iron particulate. Fluidization of the sponge iron particulate by the cooled gas serves both to reduce the temperature of the particulate and to separate and remove smaller or lighter particles and fines of the sponge iron for fluidized transfer upwardly through tubular riser 18*b*. The remaining sponge iron particulate, which is principally heavier or larger, solid sponge iron particles or pellets, flow downwardly and into conveyor 25.

The separated fines flow upwardly through riser tube 18*b*, through conduit 19 into the separator 20 wherein the fines are separated from the gas, the cleaned cooling gas and amine flowing through conduit 42 to the central support tube 28 of cooling reactor 26 and the separated or filtered fines and smaller particles being transferred through conduit 22 to the fines bin 16. The fines and smaller particles may be transferred from the fines bin 16 under gas pressure from the line 15 to a briquetting plant or other destination.

The remaining sponge iron travels along conveyor 25 and enters the spiral vibratory conveyor 27 at 27*a* and travels upwardly around tube 28 toward outlet 27*b*.

The clean cooling gas and amine enters the central support tube 28 from conduit 42 and flows downwardly therethrough and outwardly of the tube 28 through openings such as 35 and 36 above and below the vibrating, perforated support deck 33. The cooling gas and amine passes over the vibrating solid sponge iron particles and cools the sponge iron particles as they are transferred upwardly along the spiral path to the exit 27*b*. The temperature of the cooling gas containing the amine flowing radially outwardly through openings such as 35 and 36 is sufficiently low, and the exposure of the solid particulate to the cooling gas and amine as it is vibrated is sufficiently great, that the sponge iron particulate is reduced to a safe temperature and inhibited by amine contact against reoxidation prior to exit at vibratory conveyor exit point 27*b*. The cooling gas and excess amine flows outwardly through the vibrating remaining sponge iron particulate and into the interior of the cooling vessel 26*a* and upwardly through the perforated barrier 36*a* into outlet conduit 26*b*. The cooling gas and amine, which will undoubtedly contain some more fines and perhaps dust, is then cleaned in the wet scrubber 40 before flowing through conduit 41 back to entrance line or conduit 11. The concentration of the amine which enters into solution with the scrubbing water will quickly reach an equilibrium point such that, at the rates employed, the amount of amine remaining in the cooling gas will not be further reduced upon passing through the water scrubber. At that point it will only be necessary to add amine to the cooling gas which is recycled sufficient to make up for the amount of amine which has interacted with the sponge iron treated. The amount of amine make up required may readily be determined by gas analysis of the cooling gas which is recycled to compressor 10 and cooling coil 14. This may be conveniently performed by gas chromatographic analysis or like methods. The sponge iron coming out of the cooling reactor 26 at conveyor exit 27*b* is now at a sufficiently low temperature and sufficiently inhibited by amine contact that it will not reoxidize upon contact with air or water and is thus safe for shipment and storage.

A further feature of this invention is the utilization of the nozzles 34 to provide a cooling liquid mist to the vibration sponge iron particles. It is contemplated that a cooling mist, such as water, will only be applied to the latter or upper spirals after the temperature of the vibrating sponge iron particulate has already been sufficiently reduced. Basically, the addition of the mist is to finally prepare the vibrating, cooled sponge iron particulate for exposure to the environment at the exit conveyor 27*b*. If the cooling mist alternative is employed a water soluble amine may be added thereto to further complete the inhibition of the sponge iron against reoxidation. In such cases an aqueous amine solution containing from about 0.1 to about 2.0 percent by weight of a water soluble amine may be employed as the cooling mist.

Alternatively, the amine may be added to the cooling gas as it exits conduit 19, such as at amine addition point 71.

The method M-2 of reducing the temperature of recently-produced sponge iron is accomplished by apparatus A-2 of FIG. 4. Basically, the same equipment is utilized in apparatus A-2 as in apparatus A-1. Therefore, wherever possible, the same number or letter designations will be utilized. The method M-2 for reducing the temperature of recently-produced sponge iron is provided by transferring sponge iron S from reactor bin 51 through conveyor 50 to the separator or fluidizing vessel 18. The fluidizing vessel 18 includes a central fluidizing housing 18*a* having mounted thereon a rise tube 18*b*. Cooling gas enters the apparatus A-2 through entry line 60 and joins recycling gas from line 61 for compression in compressor 10 and cooling through cooling coil 62. The compressed and cooled gas is then delivered to compressed cooling gas line 63 connected to the central support tube 28 of the cooling reactor 26. Conveniently the amine may be added to the cooling gas while in line 63. The compressed, cooled gas to which the amine has been added flows outwardly through the vibrating spiralled conveyor 26 in the same manner as has been described with respect to the method M-1. The finally cooled and amine treated sponge iron exits through conveyor 64 which is attached to the top exit spiralled conveyor portion 27*b*. The cooling gas, however, is not at this point collected and filtered for reuse as in the method M-1, but rather, the cooling gas of the method M-2 exits through line 65 which is connected to vessel plenum chamber 66. The vessel plenum chamber 66 is an annular chamber that surrounds the fluidizing vessel housing 18*a*, which is provided with suitable openings such as 66*a* illustrated schematically in FIG. 4, for allowing gas entry into the vessel 18*a* for fluidizing the sponge iron coming off of conveyor 50. The fluidizing gas again separates fines and lighter sponge iron particles for transfer through riser conduit 18*b* into separators 20. Any excess amine remaining in the cooling gas upon exiting from cooling reactor 26 contacts and inhibits the finer sponge iron particles which are separated in vessel 18. The separators 20 are illustrated as being cyclone separators and again are water cooled by water jacketing at 21 for cooling the fines and lighter particles prior to collection in horizontal vibratory feeder 22 and subsequent depositing in the fines bin 16. The cooling gas and amine, cleaned of fines and lighter particles, enters transfer conduit 67 for flow to bag house 68 and then flow into return line 61. The further filtered particles exit through lines 68*a* and 68*b* of the bag house and also enter the fines bin 16 through line 69. The recycled gas coming out of the bag house enters line 61 and is joined by makeup line 60 prior to entry into cooling coil 62. The fines again are sent to a briquetting process or other destination as desired.

The larger, more solid particulate flows downwardly through the separator housing 18*a* and into horizontal vibrating conveyor 25 for transfer to the spiralling or helical vibratory conveyor 27. As the more solid particles travel upwardly, cooling gas and the amine flowing through central support tube or downcomer 28 cools and contacts the vibrated particulate in the same manner as has been described with respect to FIGS. 2 and 3. In this manner, the temperature of the sponge iron leaving through the top spiral conveyor end portion 27*b* is reduced to a safe level and thoroughly contacted with the amine thus pacifying the material for exposure to air or other ambient oxidizers.

In the embodiments of both processes M-1 and M-2, the cooling gas is an inert gas in that it has no oxidizing ingredients therein to reoxidize with the recently-produced sponge iron. The inert gas may be any suitable reducing gas including a reducing tail gas taken from the reduction process itself, provided it is first treated to eliminate excess hydrogen and is cooled to a temperature suitable for use as a cooling gas; or, the cooling gas may be truly an inert gas from another source.

Addition of the amine to the gas used to cool the sponge iron is the preferred method of contacting the sponge iron with the amine. This method of treatment is convenient, does not require any additional processing steps per se and gives the maximum chance for the amine to permeate the pores of the sponge iron to thus inhibit oxidation at its interior active surfaces.

Another method for contacting the sponge iron with an amine would be to immerse it in an aqueous amine solution. The amine concentration may range from about 0.1 to about 2.0 percent by weight. Generally only amines having six or fewer carbon atoms are sufficiently water soluble to be suitable for an immersion method. When an immersion method is employed it is preferrable to cool the sponge iron to about 70° F. prior to immersion in the amine solution. After immersion the sponge iron may be heated to dryness or may be allowed to dry by natural evaporation.

The foregoing disclosure and description of the invention are illustrative and explanatory thereof, and various changes and alterations may be made without departing from the spirit of the invention.

I claim:

1. A method for reducing the temperature of recently reduced sponge iron to a safe level and inhibiting it against reoxidation, comprising the steps of:

transferring freshly reduced sponge iron in particulate form to a separator vessel, such sponge iron at temperatures dangerously high making it susceptible to undesirable oxidation by contact with air;

passing a cooling gas stream through said sponge iron in order to initially cool and fluidize lighter particles and fines and transferring by fluidization said light particles and fines from said sponge iron so that heavier solid particles remain;

transferring the remaining sponge iron to a vibratory conveyor and conveying the remaining sponge iron by vibratory motion toward a storage area;

adding an amine containing from about one to about twelve carbon atoms to said cooling gas; and contacting said cooling gas containing said amine with the remaining sponge iron as it is conveyed by said vibratory motion to a storage area thereby cooling to a safe temperature and inhibiting the reoxidation of the sponge iron.

2. The method set forth in claim 1, where said conveying step includes:

conveying the remaining sponge iron along a vibratory, helical path toward said storage area; and said cooling gas containing said amine is directed through the remaining sponge iron as it is vibratorily conveyed along said helical path in order to simultaneously cool and inhibit the remaining sponge iron pellets.

3. The method set forth in claim 1, including the step of:

applying a cooling mist containing an amine to said vibrated, remaining sponge iron pellets simultaneously with the application of said cooling gas containing said amine to the remaining sponge iron pellets during the vibratory conveyance of same.

4. A method of inhibiting freshly reduced sponge iron from reoxidizing, comprising the step of:

contacting said sponge iron after cooling to a temperature below 250° F. with an amine containing from about 1 to about 12 carbon atoms.

5. A method of inhibiting freshly reduced sponge iron from reoxidation, comprising the step of:

contacting said sponge iron with an amine containing from about 1 to about 12 carbon atoms while the sponge iron is at a temperature of from about 125° F. to about 250° F.

6. The process of claim 5, wherein the amine is in the gas phase when it is contacted with the sponge iron.

7. The process of claim 6, wherein the amine is added to a cooling gas and is contacted with the sponge iron simultaneously with the cooling gas.

8. The process of claim 7, wherein the amine has a boiling point less than about 100° F. and is vaporized upon its addition to the cooling gas.

9. The process of claim 7, wherein the amine has a boiling point greater than 100° F. and is added to the cooling gas as an aerosol.

10. The process of claim 9, wherein the amine vaporizes upon contact with the sponge iron.

11. The process of claim 7, wherein the amine is present in the cooling gas in an amount of about 500 to about 20,000 ppm by volume.

12. The process of claim 11, wherein the amine is present from about 2,000 to about 5,000 ppm by volume.

13. The process of claim 7, wherein the amine is a diamine.

14. The process of claim 13, wherein the amine is ethylene diamine.

15. The process of claim 7, wherein the pressure of the amine containing cooling gas is cycled from about 100 inches of water gauge to about 25 inches of water gauge at a rate of from about one to about thirty times per minute.

* * * * *